US008973705B2

(12) United States Patent
Guthrie et al.

(10) Patent No.: US 8,973,705 B2
(45) Date of Patent: Mar. 10, 2015

(54) SWIVEL D-RING ATTACHMENT POINT

(75) Inventors: Karl Guthrie, Austin, TX (US); Joseph Schwartz, Wimberley, TX (US)

(73) Assignee: Climb Tech, LLC, Austin, TX (US)

( * ) Notice: Subject to any disclaimer, the term of this patent is extended or adjusted under 35 U.S.C. 154(b) by 589 days.

(21) Appl. No.: 12/807,290

(22) Filed: Sep. 1, 2010

(65) Prior Publication Data

US 2010/0326767 A1 Dec. 30, 2010

(51) Int. Cl.
*A62B 35/00* (2006.01)

(52) U.S. Cl.
CPC ..... *A62B 35/0068* (2013.01); *A62B 35/0037* (2013.01)
USPC ..... 182/3; 59/95; 24/265 AL; 24/165

(58) Field of Classification Search
USPC ..... 182/3; 119/770, 857; 24/265 BC, 265 H, 24/265 AL, 165, 185; 248/339; 59/95
See application file for complete search history.

(56) References Cited

U.S. PATENT DOCUMENTS

| | | | | | |
|---|---|---|---|---|---|
| 361,683 | A | * | 4/1887 | Eckhart | 54/53 |
| 641,265 | A | * | 1/1900 | Brassington | 24/598.5 |
| 778,963 | A | * | 1/1905 | Guffin | 278/115 |
| 942,681 | A | * | 12/1909 | Theiling | 59/95 |
| 1,059,812 | A | * | 4/1913 | Barry | 24/601.1 |
| 1,545,377 | A | * | 7/1925 | Westmoreland | 294/82.2 |
| 2,163,420 | A | * | 6/1939 | Wells | 24/599.4 |
| 2,303,954 | A | * | 12/1942 | Roke | 182/3 |
| 2,400,291 | A | * | 5/1946 | D Aleo | 59/95 |
| 2,601,589 | A | * | 6/1952 | Childers, Sr. | 182/9 |
| 2,744,673 | A | * | 5/1956 | Freeland | 182/3 |
| 2,815,556 | A | * | 12/1957 | Neil | 24/327 |
| 2,868,485 | A | * | 1/1959 | Friel | 248/59 |
| 2,942,819 | A | * | 6/1960 | Brogan | 248/58 |
| 3,270,494 | A | * | 9/1966 | Holmes | 59/86 |
| 3,738,449 | A | * | 6/1973 | Arancio | 182/7 |
| 4,224,722 | A | * | 9/1980 | Mikosz et al. | 24/601.5 |
| 4,410,175 | A | * | 10/1983 | Shamp | 482/69 |
| 4,482,264 | A | * | 11/1984 | Kodera | 403/58 |
| 4,680,837 | A | * | 7/1987 | Rubinstein | 24/601.2 |
| 4,699,410 | A | * | 10/1987 | Seidel | 294/215 |
| 4,858,977 | A | * | 8/1989 | Mitchell | 294/82.1 |
| 4,958,796 | A | * | 9/1990 | Bernosky | 248/317 |
| 5,009,386 | A | * | 4/1991 | Berger et al. | 248/613 |
| 5,219,427 | A | * | 6/1993 | Harris | 248/59 |
| 5,220,977 | A | * | 6/1993 | Wolner | 182/18 |

(Continued)

OTHER PUBLICATIONS

Definition of 'circular' provided in Action Collins English Dictionary—Complete and Unabridged © HarperCollins Publishers 1991, 1994, 1998, 2000, 2003.*

(Continued)

*Primary Examiner* — Daniel Cahn
(74) *Attorney, Agent, or Firm* — Portland Intellectual Property, LLC

(57) ABSTRACT

A swivel D-ring attachment point. A first attachment portion has a first closed aperture defining a circular ring portion that extends over a first circumferential range of at least 180 degrees of arc that is symmetrically disposed relative to an axis. A second attachment portion has a second closed aperture. The first and second attachment portions are joined together so as to permit freely swivelling one of the attachment portions relative to the other around the axis. The second aperture has a shape that is substantially different from the shape of the first aperture, for connecting to substantially different articles.

2 Claims, 6 Drawing Sheets

(56) References Cited

U.S. PATENT DOCUMENTS

| | | | | | |
|---|---|---|---|---|---|
| 5,248,176 | A * | 9/1993 | Fredriksson | 294/215 |
| 5,274,887 | A * | 1/1994 | Fudaki | 24/265 H |
| 5,279,386 | A * | 1/1994 | Cearley | 182/3 |
| 5,361,867 | A * | 11/1994 | Olson et al. | 182/18 |
| 5,365,642 | A * | 11/1994 | Rekuc et al. | 24/600.9 |
| 5,398,389 | A * | 3/1995 | Terada et al. | 24/599.8 |
| 5,415,446 | A * | 5/1995 | Olson et al. | 294/82.24 |
| 5,438,736 | A * | 8/1995 | Terada et al. | 24/599.8 |
| 5,450,661 | A * | 9/1995 | Rekuc | 24/599.6 |
| 5,471,716 | A * | 12/1995 | Takahashi | 24/615 |
| 5,474,274 | A * | 12/1995 | Bernosky | 248/317 |
| 5,518,351 | A * | 5/1996 | Peil | 411/383 |
| 5,566,428 | A * | 10/1996 | Takahashi | 24/265 H |
| 5,687,535 | A * | 11/1997 | Rohlf | 52/713 |
| 5,755,542 | A * | 5/1998 | Janusz et al. | 411/387.4 |
| 5,913,383 | A * | 6/1999 | Tseng | 182/236 |
| 5,964,316 | A * | 10/1999 | Roy | 182/3 |
| 6,068,310 | A * | 5/2000 | Fuller et al. | 294/215 |
| 6,076,633 | A * | 6/2000 | Whitmer | 182/36 |
| 6,092,623 | A * | 7/2000 | Collavino | 182/3 |
| 6,161,505 | A * | 12/2000 | Noguero | 119/792 |
| 6,298,629 | B1 * | 10/2001 | Ador | 52/698 |
| 6,551,041 | B2 * | 4/2003 | Choate | 411/348 |
| 6,691,827 | B2 * | 2/2004 | Lycett | 182/138 |
| 6,694,574 | B1 * | 2/2004 | Sheng | 24/265 H |
| 6,749,237 | B1 * | 6/2004 | Ma | 294/180 |
| 6,837,337 | B2 * | 1/2005 | Thomas et al. | 182/8 |
| 7,000,730 | B1 * | 2/2006 | Ostrobrod | 182/36 |
| 7,082,664 | B2 * | 8/2006 | Powers et al. | 29/525.02 |
| 7,111,707 | B2 * | 9/2006 | Reeves | 182/36 |
| D539,697 | S * | 4/2007 | Mackay | D11/200 |
| 7,343,647 | B1 * | 3/2008 | Kinskey et al. | 24/3.13 |
| 7,357,099 | B2 * | 4/2008 | Smith et al. | 119/771 |
| 7,992,263 | B2 * | 8/2011 | Uehara | 24/265 H |
| D649,018 | S * | 11/2011 | Kope | D8/367 |
| 8,096,384 | B2 * | 1/2012 | Caylor et al. | 182/3 |
| D659,518 | S * | 5/2012 | Xu | D8/356 |
| 8,172,476 | B2 * | 5/2012 | Berney | 403/164 |
| 8,210,311 | B1 * | 7/2012 | Rice | 182/9 |
| 8,312,966 | B1 * | 11/2012 | Guthrie et al. | 182/36 |
| 8,646,575 | B1 * | 2/2014 | Guthrie et al. | 182/3 |
| 2001/0011694 | A1 * | 8/2001 | Lycett | 248/228.1 |
| 2001/0025464 | A1 * | 10/2001 | Poldmaa | 52/633 |
| 2003/0010567 | A1 * | 1/2003 | Gayetty | 182/3 |
| 2004/0087382 | A1 * | 5/2004 | Goldstein | 472/118 |
| 2005/0034920 | A1 * | 2/2005 | Anderson | 182/3 |
| 2005/0125962 | A1 * | 6/2005 | Hong | 24/265 H |
| 2005/0127235 | A1 * | 6/2005 | McPherson | 242/597.7 |
| 2005/0161285 | A1 * | 7/2005 | Blackford et al. | 182/36 |
| 2005/0205356 | A1 * | 9/2005 | Velasco | 182/3 |
| 2006/0239770 | A1 * | 10/2006 | Liu | 403/161 |
| 2007/0163834 | A1 * | 7/2007 | Casebolt | 182/3 |
| 2007/0261210 | A1 * | 11/2007 | Chen | 24/265 H |
| 2009/0178887 | A1 * | 7/2009 | Reeves et al. | 182/239 |
| 2010/0006373 | A1 * | 1/2010 | Bodnar | 182/36 |
| 2010/0139052 | A1 * | 6/2010 | Lin | 24/265 H |
| 2010/0147624 | A1 * | 6/2010 | Caylor et al. | 182/129 |
| 2012/0160605 | A1 * | 6/2012 | Guillermety | 182/48 |
| 2013/0025968 | A1 * | 1/2013 | Smith et al. | 182/3 |
| 2013/0327591 | A1 * | 12/2013 | Galpin et al. | 182/3 |

OTHER PUBLICATIONS

Definition of 'ring' provided in Action The American Heritage® Dictionary of the English Language, Fourth Edition copyright ©2000 by Houghton Mifflin Company. Updated in 2009. Published by Houghton Mifflin Company. All rights reserved.*

Definition of 'circumference' provided in Action The American Heritage® Dictionary of the English Language, Fourth Edition copyright ©2000 by Houghton Mifflin Company. Updated in 2009. Published by Houghton Mifflin Company. All rights reserved.*

Definition of 'arc' provided in Action The American Heritage® Dictionary of the English Language, Fourth Edition copyright ©2000 by Houghton Mifflin Company. Updated in 2009. Published by Houghton Mifflin Company. All rights reserved.*

Definition of "diameter" provided in Action Collins English Dictionary—Complete and Unabridged © HarperCollins Publishers 1991, 1994, 1998, 2000, 2003.*

Definition of "circular" provided in Action Collins English Dictionary—Complete and Unabridged © HarperCollins Publishers 1991, 1994, 1998, 2000, 2003.*

Definition of "circumference" provided in Action The American Heritage® Dictionary of the English Language, Fourth Edition copyright ©2000 by Houghton Mifflin Company. Updated in 2009. Published by Houghton Mifflin Company. All rights reserved.*

Definition of 'pin' provided in the Final Action Collins English Dictionary—Complete and Unabridged© HarperCollins Publishers 1991, 1994, 1998, 2000, 2003.*

Definition of 'diameter' provided in Final Action the American Heritage® Dictionary of the English Language, Fourth Edition copyright ©2000 by Houghton Mifflin Company. Updated in 2009. Published by Houghton Mifflin Company. All rights reserved.*

Definition of 'interrupt' provided in Final Action the American Heritage® Dictionary of the English Language, Fourth Edition copyright ©2000 by Houghton Mifflin Company. Updated in 2009. Published by Houghton Mifflin Company. All rights reserved.*

Synonyms for 'interruprtion' provided in Final Action Based on WordNet 3.0, Farlex clipart collection. © 2003-2012 Princeton University, Farlex Inc.*

Economy Advantage, web page at "http://www.fallprotection.com/images/lanyards1new.jpg", publication date unknown.

Inner Mountain Outfitters web page at "http://innermountainoutfitters.net/catalogentry.php?search=&page=all&catalogentryid=630", publication date unknown.

"Understanding the ANSI Z359 Fall Protection Code", Miller by Sperian, pp. 1- 16, publication date unknown.

Pensafe.Ca, web page at "www.pensafe.ca/pdf/miscellaneous.pdf", publication date unknown.

* cited by examiner

Prior Art

SWIVEL D-RING ATTACHMENT POINT

FIELD OF THE INVENTION

The present invention relates to a D-ring attachment point, which is hardware that is used in providing for fall protection.

BACKGROUND

In construction, there is a need to tether construction workers to the structure being constructed, so that if the worker falls, the fall is shortened so that the worker is not injured or killed. Typically, the worker wears a harness, and the harness is removably connected, or attached, to a lanyard. Essentially, a lanyard is a flexible tensile member such as a rope, cable, or web that has attachment hardware, typically a carabiner, at each end. Typically, at one end of the lanyard, the lanyard is coupled to an "anchor point" on the structure, and at the other end of the lanyard, the lanyard is coupled to the harness.

To couple the lanyard, specifically the carabiner at the end thereof, to either the harness or the anchor point requires yet another piece of attachment hardware known as a "D-ring." A typical D-ring 2 is shown in FIG. 1, and FIG. 2 shows a lanyard 4 attached to the D-ring 2 via a carabiner 6.

Referring to FIG. 1, the D-ring 2 generally has two closed apertures $A_1$ and $A_2$. The larger aperture $A_1$ is for receiving the carabiner. The smaller aperture $A_2$ is for attaching to a structure. For example, FIG. 3 shows the D-ring 2 attached to a harness 8 formed of webbing 7. A loop of the webbing extends through the aperture $A_2$, to connect the D-ring to the harness.

FIG. 4 shows another example, where the D-ring 2 used as an anchor point attached to a wall 9 of the structure. In this example, a (typically) metal loop structure or strap 5 extends through the aperture $A_2$, the strap being bolted to the wall.

The D-ring must be strong enough to meet ANSI standard Z359.1 for the given application, which requires at least the capacity to withstand 5000 pounds force, either tensile or shear, applied to the D-ring through the lanyard 4, in an operating environment such as the configuration of FIG. 4.

The present invention improves upon the D-ring described above.

SUMMARY

A swivel D-ring attachment point is disclosed herein. A first attachment portion thereof has a first closed aperture therethrough defining a circular ring portion that extends over a first circumferential range of at least 180 degrees of arc that is symmetrically disposed relative to an axis. A second attachment portion of the attachment point has a second closed aperture therethrough. The first and second attachment portions are joined together so as to permit freely swivelling one of the attachment portions relative to the other around the axis. The second aperture has a shape that is substantially different from the shape of the first aperture, for connecting to substantially different articles.

Preferably, the first aperture is for connecting to a carabiner, and is so adapted by providing the circular ring portion described above, to which the carabiner removably attaches.

Preferably, the second aperture is for connecting to a strip of webbing material, or other structure having similar overall dimensional characteristics, and is so adapted by having a generally rectangular shape, through which the webbing or other structure extends.

In the configuration in which the first aperture is adapted to receive a carabiner and the second aperture is adapted to receive a strip of webbing material, the area of the second aperture is preferably substantially less than the area of the first aperture.

Preferably, one of the attachment portions, preferably the second attachment portion, has a projecting cylindrical shank, where the other has a corresponding cylindrical hole for receiving the shank.

Where the hole is provided, the hole preferably has one or more grooves extending 360 degrees about the axis in a plane perpendicular thereto, for clearing one or more shear pins laterally extending from the shank.

D-ring attachment points as disclosed herein are preferably utilized in an anchor point which comprises an elongate bar member having an elongate axis, the bar member supporting two spaced apart, generally C or L-shaped capturing members adapted for hanging the bar member from a flange, wherein the structure attachment portion is attached to the bar member, between the capturing members.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 5:
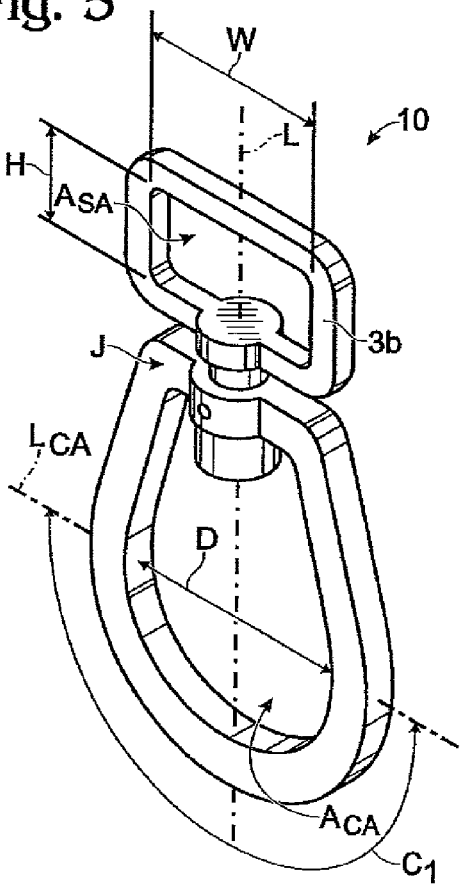
FIG. 5 is an isometric view of a swivel D-ring attachment point according to the present invention.

FIG. 5 shows a preferred embodiment of a D-ring 10 according to the claimed invention. The D-ring is formed of a material and in a configuration suitable to enable it to withstand 5000 pounds force, either tensile or shear, applied to the D-ring as described above. The D-ring is preferably formed of metal for this purpose, but it could also be formed, in whole or in part, of an engineered plastic, particularly a graphite or glass reinforced plastic.

Figure 1:
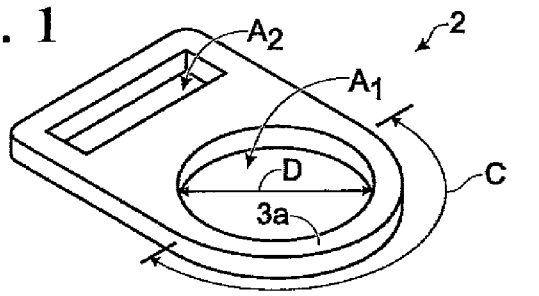
FIG. 1 is an isometric view of a typical prior art D-ring.
Figure 4:
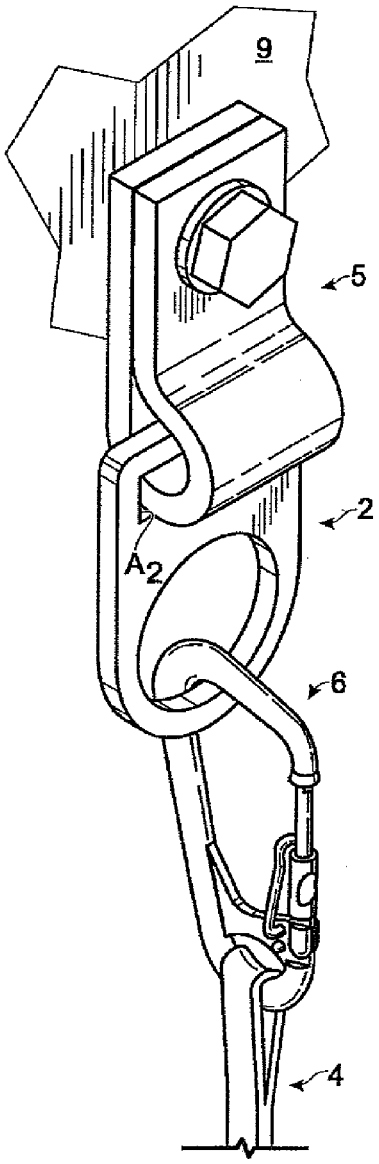
Prior Art Fig. 4
FIG. 4 is an isometric view of the D-ring of FIG. 1 used as an anchor point.
Figure 3:
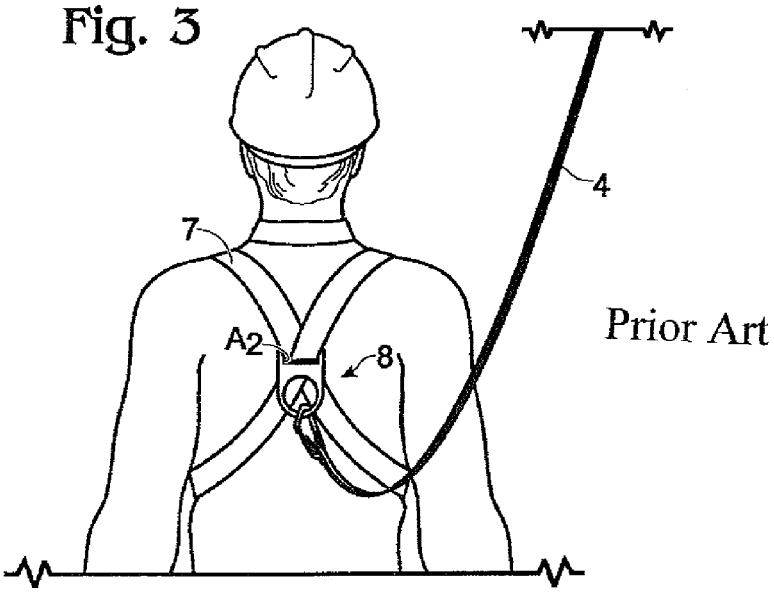
FIG. 3 is a pictorial view of the D-ring of FIG. 1 used to connect to a harness.

The D-ring 10 has apertures $A_{CA}$ and $A_{SA}$. The significance of the subscripts will be made clear. In general, the larger aperture $A_{CA}$ is used as a receiver for removably attaching the carabiner, whereas the smaller aperture $A_{SA}$ is used for relatively permanently attaching the D-ring to some other structure, such as the harness of FIG. 3, or the wall of FIG. 4, so the size and shape of the smaller aperture $A_{SA}$ can vary as desired to suit this latter purpose. Consistent with these functions, the larger aperture $A_{CA}$ is referred to herein as a "carabiner-attachment" aperture, and the smaller aperture $A_{SA}$ is referred to as a "structure-attachment" aperture.

Figure 6:
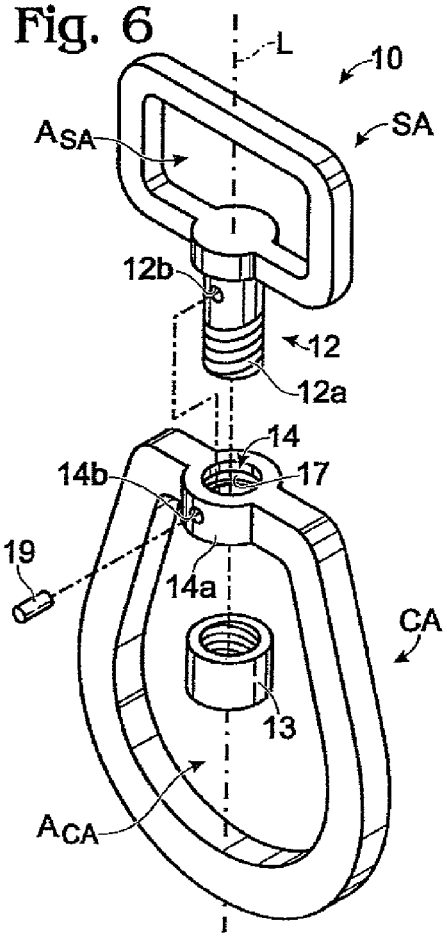
FIG. 6 is an exploded view of the swivel D-ring attachment point of FIG. 5.

With reference to FIG. 6, the D-ring 10 comprises two separate ring-like portions "CA" (for "carabiner-attachment") and "SA" (for "structure-attachment"). The ring-like portion CA defines the aperture $A_{CA}$ and the ring-like portion SA defines the aperture $A_{SA}$. The apertures are both "closed," meaning that each ring-like portion CA and SA continuously surrounds its respective aperture, to provide for strength and to prevent the articles connected to the respective apertures from escaping through gaps in the portions.

The two portions CA and SA are joined together at a swivel joint "J" (FIG. 5), producing a novel, swivel D-ring configuration. This allows, for example, the swivel action that can be discerned by comparing FIGS. 5 and 7, where the portions CA and SA are free to swivel or rotate relative to each other about a swivel axis "L." Preferably, the portions CA and SA are free to swivel 360 degrees or more about the swivel axis L.

Figure 7:
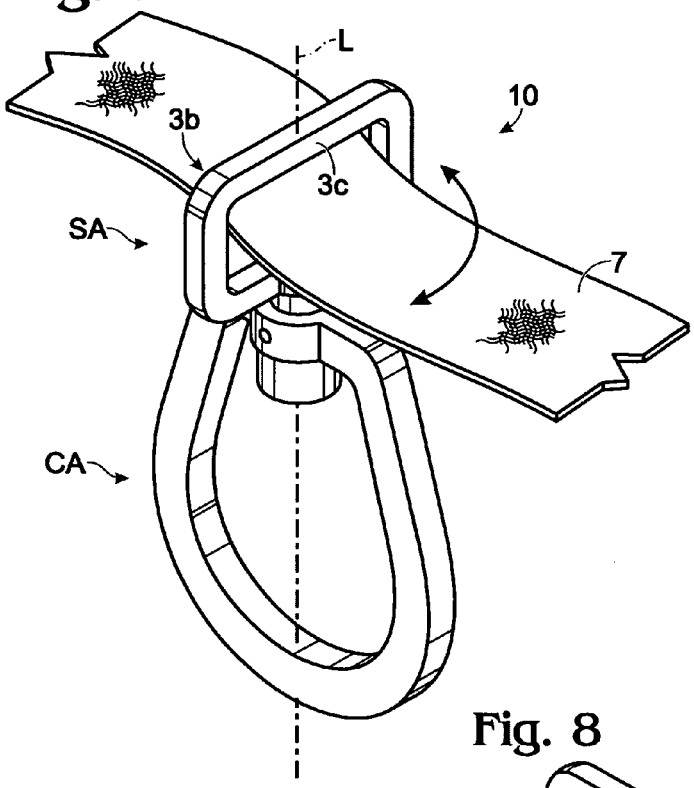
FIG. 7 is an isometric view of the swivel D-ring attachment point of FIG. 5 wherein a carabiner-attachment portion is swiveled relative to a structure-attachment portion as compared to the orientations of the same portions in FIG. 5.
Figure 8:
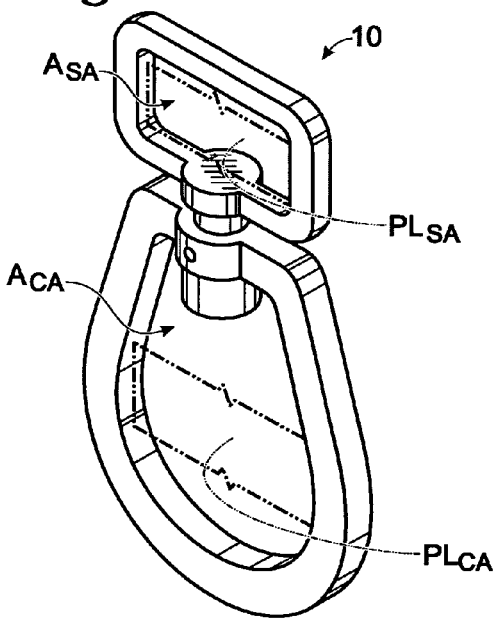
FIG. 8 is an isometric view of the swivel D-ring attachment point that corresponds identically to FIG. 5.

The portions CA and SA lie in planes, the planes "PL" being shown in a separate figure, FIG. 8, for clarity, referenced as $PL_{CA}$ and $PL_{SA}$. The portions CA and SA in FIG. 5 are in relative orientations such that these planes are aligned, as they are in FIG. 8. In FIG. 7, these planes (not shown in FIG. 7) are 90 degrees out of alignment as a result of swivel action. However, regardless of the relative angular orientations of the portions CA and SA, the swivel axis L lies in both planes $PL_{CA}$ and $PL_{SA}$.

Both apertures $A_{CA}$ and $A_{SA}$ are preferably centered about the swivel axis L, and are preferably bilaterally symmetric about this axis, so that the swivel axis L is also a central axis of the D-ring 10, and so the load the D-ring 10 carries will tend to be carried through this central axis and not shift to one side or the other resulting in imbalanced loading. Preferably as well, both ring-like portions CA and SA are also bilaterally symmetric about the swivel axis L, though the advantage this provides, while of the same nature, is less important.

The carabiner-attachment aperture $A_{CA}$ defines a circular portion 3*a* of the ring-like portion CA defining an arc of a circle of diameter "D" that extends over a circumferential range "$C_1$" of at least 180 degrees. This is considered for regulatory purposes to be important to prevent the carabiner from "rolling out" from the ring portion to become disconnected. However, it should be noted that provision of the capability of the portion CA to swivel relative to the portion SA will reduce this tendency, which is an important advantage of the present invention.

The circular portion 3*a* of the ring-like portion CA has an inside diameter "D" that is preferably in the range 1⅞" to 2½"; more preferably in the range 2" to 2⅜"; more preferably still in the range 2⅛" to 2⅜", and most preferably 2¼"+/−1/16".

The aforementioned minimum circumferential range $C_1$ is oriented as shown relative to a line $L_{CA}$ that is perpendicular to the swivel axis L. The portion CA preferably narrows substantially from its maximum width, defined at the line $L_{CA}$, to its termination at the swivel joint J, such as by being generally "pear" shaped as shown, or by continuing the circular arc beyond the line $L_{CA}$ as far as is desired, in either direction. However, this narrowing is not essential, and aside from the requirement for 180 degrees of circular arc as described, the portion CA may have any shape that is desired.

Simplicity is preferred, and a simple embodiment of the swivel joint J between the portions CA and SA comprises a cylindrical shank extending from one of the portions, through a hole in the other portion. For example, as seen in FIG. 6, the portion SA may be provided with an integral projecting shank 12, and a corresponding cylindrical hole 14 may be provided through a boss 14*a* in the portion CA to receive the shank and provide a bearing surface therefor. An equally preferred alternative would be to provide the shank as part of the portion CA with the hole being carried by the portion SA. Preferably, the clearance between the shank and hole is about 0.005-0.015" to allow for free rotation while at the same time providing for satisfactory alignment of the parts.

To capture the shank within the hole, the simple embodiment provides a threaded end 12*a* of the shank that protrudes beyond the hole when the portions CA and SA are joined, and a locking nut 13 is applied to the threaded end after the portions are assembled. In an alternative simple embodiment, the shank could be swaged or riveted at its end.

It will be appreciated that a swivel joint can be provided in many ways, and the particular choice of how to join the two portions CA and SA is not critical to the invention. However it is implemented, the swivel joint provides for, preferably, greater than 360 of free rotation of one of the portions relative to the other about the swivel axis L.

Referring back to FIG. 6, the D-ring 10 may advantageously include a shear pin 19 that extends through corresponding holes, in the boss 14*a* and shank 12, as indicated. The shear pin may be inserted through the hole 14*b* in the boss so that it engages the hole 12*b* in the shank, and is pressed through the hole 12*b* so that it extends past the shank 12 at both ends of the hole 12*b*. An internal groove 17 in the boss 14*a* receives the lengths of pin extending past the ends of the hole 12*b*, allowing the portions SA and CA to swivel while retaining the portions together.

The shear pin is designed to support the normal, rated loading of the D-ring, and to break away (shear) if the rated loading is exceeded. In such case, the portion CA is permitted to drop (along the axis L) a noticeable amount from the portion SA, so as to uncover a visible indicator on the shank 12 signaling the overload, which could simply be the hole 12*b* but which is preferably a red line on the outside of the shank 12, parallel to the groove 17. This visual indication would typically be used as a basis for discarding the D-ring.

After the shear pin breaks and the portion CA drops, the boss 14 comes to rest on the nut 13, and now becomes fully supported thereby, the nut providing back-up support. Accordingly, if a shear pin is provided, the nut 13 must be captured to the shank 12 at a lower elevation than it would if it were used to support the D-ring during ordinary use.

Referring back to FIGS. 5 and 7, the smaller, structure-attachment aperture $A_{SA}$ is defined and carried by the ring-like portion SA. The portion SA is preferably particularly adapted for receiving a strip of webbing through the aperture, such as the webbing 7 used in the harness of FIG. 3. For this purpose, it is preferably generally rectangular.

With reference to FIGS. 5 and 7, the portion SA has four bar portions, one of which is identified in FIG. 5 as 3*b* and one of which is identified in FIG. 7 as 3*c*. The bar portion 3*c*, referred to as a "distal bar portion" because it is at an extreme end of the D-ring 10, directly receives the webbing or other attachment structure and directly bears the load applied thereby, when the D-ring is loaded (in tension). In the preferred adaptation for use with flat webbing, the bar portion 3*c* is preferably straight, as shown, to provide for an even distribution of the load across the webbing. And if the webbing is not flat, the bar portion would preferably have an equivalently complementary shape to produce essentially the same result.

However, it is recognized that webbing is flexible, and that flat webbing can be supported on a curved bar portion 3*c*. This is not ideal from a loading standpoint: As more and more curvature is provided, the loading across the webbing becomes more and more uneven, but the degree of this will depend on the load as well as the thickness and stiffness of the webbing. So some amount of curvature may be acceptable. Some curvature may even be desirable to help center the webbing within the structure-attachment aperture $A_{SA}$.

Figure 9:
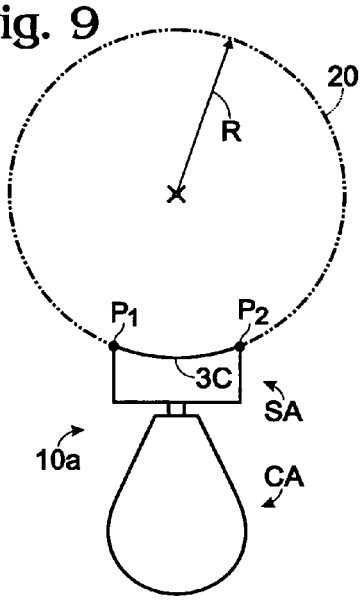
FIG. 9 is a schematic representation of a first alternative embodiment of the swivel D-ring attachment point of FIG. 5.
Figure 10:
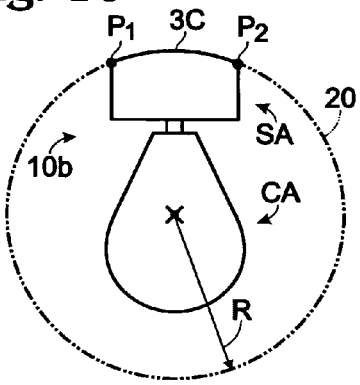
FIG. 10 is a schematic representation of a second alternative embodiment of the swivel D-ring attachment point of FIG. 5.

FIGS. 9 and 10 show two exemplary embodiments of the D-ring, referred to as 10*a* and 10*b* respectively, having curved bar portions 3*c*. In FIG. 9, the bar portion 3*c* is concave, following the arc of a circle 20 centered above the bar portion. The circle 20 has a radius "R." In FIG. 10, the bar portion 3*c* is convex, where the same circle 20 is centered below the bar portion.

Figure 11:
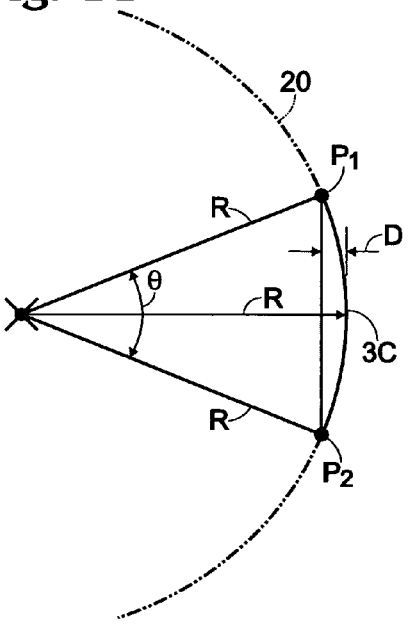
FIG. 11 is a geometric diagram for illustrating a principle associated with the alternative embodiments of FIGS. 9, 10, and 12.

FIG. 11 illustrates the amount of curvature that is allowed: The bar portion 3*c* may be curved so that the maximum deviation "D" of the bar portion from a straight line defined between its end-points is only about 10% of its straight line length, i.e. the length of the line connecting end-points $P_1$ and $P_2$. This limitation can be seen to be defined by the following equations:

$$R\cdot(1-R\cdot\cos\theta/2)\leq 0.10\cdot(\text{bar length}),\ \text{and} \quad (1)$$

$$2\cdot R\cdot\sin\theta/2=(\text{bar length}), \quad (2)$$

where R is the radius of the circle 20 equivalent circle and θ is the angle subtended by the arc (between end-points $P_1$ and $P_2$). FIG. 11 corresponds to the embodiment 10*a* of FIG. 9, but the analysis applies equally to the embodiment 10*b* of FIG. 10.

Figure 12:
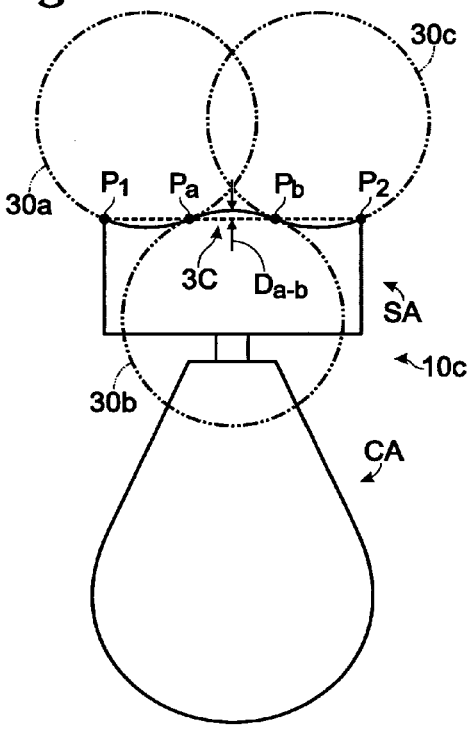
FIG. 12 is a schematic representation of a third alternative embodiment of the swivel D-ring attachment point of FIG. 5.

FIG. 12 shows another embodiment 10*c* having a curved bar portion 3*c*, in which there is series or sequence of arcs over the length of the bar portion. In this example, there are three such arcs, but there could be any number of arcs in the series or sequence. Also in this example the arcs alternate between being convex and concave, but this is not necessary either, nor is it necessary to have both convex and concave arcs.

Each of the three arcs in the example of embodiment 10*c* is defined by respective circles 30*a*, 30*b*, 30*c*, between respective pairs of end-points $P_1$ and $P_a$, $P_a$ and $P_b$, and $P_b$ and $P_2$.

Each arc in the series or sequence is treated separately to ensure satisfaction of equations (1) and (2). For example, the middle arc in FIG. 12, which is defined between end-points $P_a$ and $P_b$, will have a maximum deviation $D_{a\text{-}b}$, from a straight line drawn between the end-points $P_a$ and $P_b$, that satisfies equations (1) and (2). The result is to define the circle 30*b*, which is the circle of the smallest radius $R_b$ that is allowed for that arc.

The circles 30*a*, 30*b*, 30*c* could all have different radii, and the line lengths between the three pairs of end-points can vary independently so long as the line length between the outside end-points $P_1$ and $P_2$ is maintained.

The inside dimensions of the structure-attachment aperture $A_{SA}$ depend on the structure with which the aperture is to be used. For flat webbing, the inside width "W" (see FIG. 5) should be about ⅜" larger than the width of the webbing, which is typically between 1" and 1¾". This is primarily to accommodate two radiused (i.e. circularly shaped) corners, one at each end of the bar portion 3*c*. For example, a ⅜" width-accommodating clearance would provide exactly that needed to accommodate two corners each having a 3/16" radius.

So, for 1" wide webbing, the preferred inside width W is 1⅜", and for 1¾" wide webbing, the preferred inside width W is 2⅛". Providing less clearance will increase the tendency for bunching of the webbing at one side of the aperture, and providing more clearance will tend to cause the same result, by making it easier for the webbing to shift to one side of the aperture. However, it is not essential to provide any clearance at all, and the clearance can also be larger if desired.

Also when the ring-like portion SA is used with flat webbing, the shapes and sizes of the remaining bar portions, such as the portion 3*b*, are not important, so long as the height "H" (see FIG. 5) is sufficient to accommodate the thickness of the webbing, and allow the webbing to slide through (i.e. in and out of) the aperture. Typically, the webbing is between about 0.075" to 0.125", often there are two layers of webbing that must be accommodated (see, e.g., FIG. 8), and at least some additional height-accommodating clearance should also be provided. Preferably, a generous amount of such clearance is provided, with the height H being between about ½" to 1", most preferably about ¾".

As mentioned above, the ring-like portion CA in the embodiments shown has a generally pear shape. From FIG. 5, it is also apparent that the ring-like portion SA in the embodiment shown has a generally rectangular shape. The shapes of the ring-like portions are defined particularly in elevation, viewing the D-ring from directions perpendicular to the planes $PL_{CA}$ and $PL_{SA}$ of FIG. 8. Such a view is provided in FIG. 13.

Figure 13:
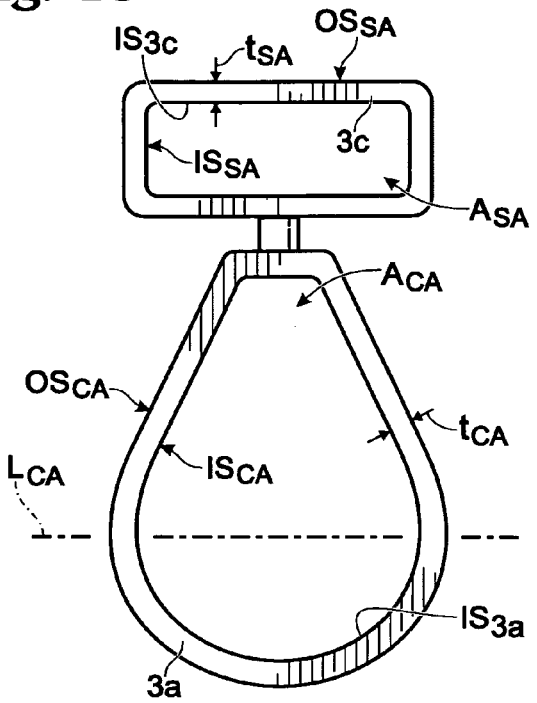
FIG. 13 is a plan view of the D-ring attachment point as shown in FIG. 5.

More specifically with reference to FIG. 13, each ring-like portion CA and SA has thickness "t," shown as "$t_{CA}$" and "$t_{SA}$," separating outside surfaces "OS," shown as "$OS_{CA}$" and "$OS_{SA}$," and inside surfaces "IS," shown as "$IS_{CA}$" and "$IS_{SA}$" of the two ring-like portions CA and SA. The shape of the aperture corresponding to a ring-like portion CA or SA is defined in outline by the inside surfaces IS of the ring-like portion, and can be defined particularly at the intersection of the corresponding plane PL with the inside surfaces IS of the ring-like portion.

Correspondingly, the shape of the ring-like portion itself is defined by the outside surfaces OS of the ring-like portion, and can be defined particularly at the intersection of the corresponding plane PL with the outside surfaces OS of the ring-like portion.

If the thickness t is constant over the perimeter of a ring-like portion, the shape of the ring-like portion will be the same as that of the corresponding aperture, but though it is desired, and it is most desirable to have a constant thickness $t_{CA}$ over the circular portion 3*a* of the ring-like portion CA, it is not essential that the thickness "t" be constant for either ring-like portion. In other words, it is not essential for the shape of either the ring-like portions CA and SA to be the same as the shapes of the corresponding apertures $A_{CA}$ and $A_{SA}$.

As is apparent from FIG. 13, the shape of the structure-attachment aperture $A_{SA}$ is substantially different from, or equivalently, is not substantially the same as, the shape of the carabiner-attachment aperture $A_{CA}$. The difference in shape reflects a difference in the articles for which the aperture is adapted to provide a connection.

The structure-attachment aperture $A_{SA}$ will be recognized as being generally rectangular even if one (or more) of the bar portions is curved within the limits described above, such as shown in FIGS. 9, 10, and 12, and even if radiused corners are provided such as shown in FIGS. 5-7. As just one alternative, for comparison, a generally triangular structure-attachment aperture $A_{SA}$ would be defined by providing 3 bar portions (the bar portion 3*c* and two connecting bar portions that are angled inwardly so as to meet one another). Such a generally triangular embodiment could also have one (or more) of the bar portions curved within the limits described above, and radiused corners.

However, as mentioned above, the distal bar portion 3*c* of the ring-like portion SA associated with structure-attachment aperture $A_{SA}$ supports the webbing or other connecting structure when the D-ring 10 is in use. It is therefore the shape of this bar portion 3*c*, particularly its inside surface "$IS_{3c}$" (FIG. 13, and represented schematically in FIGS. 9, 10, and 12) that is most important.

The 180 degree circular portion 3*a*, of the ring-like portion CA, is analogous to the distal bar portion 3*c* of the ring-like portion SA, by being disposed at the other extreme end of the D-ring and for that reason providing the surface that directly receives and supports the carabiner when the D-ring 10 is loaded. It is therefore the difference in the shapes of these components that is most important. Particularly, it is the differences in the shapes of the inside surfaces of these components, which for the circular portion 3*a* is referenced as "$IS_{3a}$" in FIG. 13. As is generally the case, as described above, the shape of the inside surface $IS_{3c}$ of the distal bar portion 3*c*, and the shape of the inside surface $IS_{3a}$ of the circular portion 3*a*, can each be defined particularly at the intersection of the corresponding plane PL therewith.

So while many differences in the shapes of the apertures $A_{CA}$ and $A_{SA}$ are possible, it is a sufficient difference for purposes herein that the structure-attachment aperture $A_{SA}$, as defined by the inside surface $IS_{3c}$(FIG. 13) of the distal bar portion 3*c*, is either linear, or it can be gently curved with a maximum curvature defined by the aforementioned equations (1) and (2), defining one or more arcs the angular extent of which will always be much less than 90 degrees, whereas the carabiner-attachment aperture $A_{CA}$, as defined by the inside surface of the circular portion 3*a* of the ring-like portion CA, is curved over an arc of at least 180 degrees.

As a related consideration, the areas of the apertures $A_{CA}$ and $A_{SA}$ will typically differ according to the size and configurational requirements of the different articles to which the apertures connect. Preferably, the areas of the apertures differ by at least 10%; and more preferably, differ by at least 50%. More preferably, the area of the structure-attachment aperture $A_{SA}$ is at least 10% less than the area of the carabiner-attachment aperture $A_{CA}$; and more preferably still, it is at least 50% less.

Figure 2:
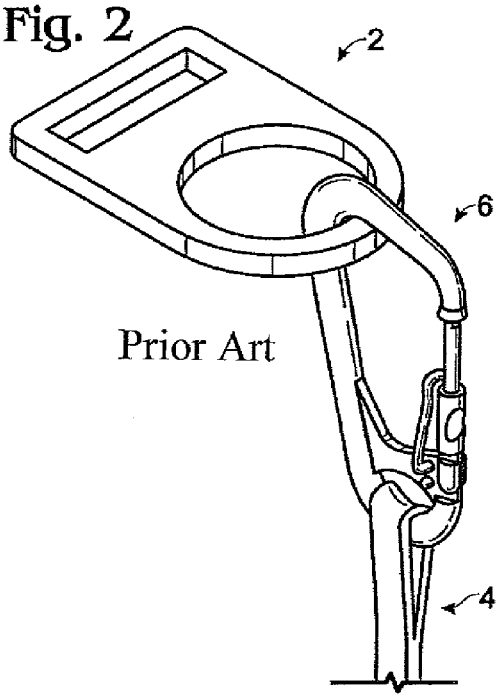
Prior Art Fig. 2
FIG. 2 is an isometric view of a lanyard connected to the D-ring of FIG. 1 via a carabiner.
Figure 14:
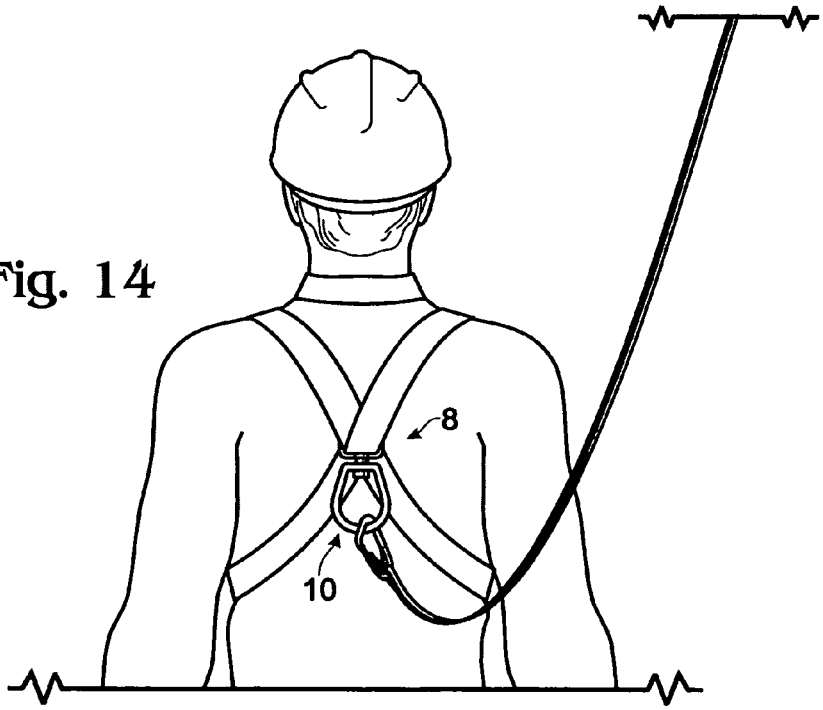
FIG. 14 is an isometric view of the D-ring attachment point of FIG. 5 used to connect to a harness.

FIG. 14 shows the D-ring 10 used to replace the D-ring 2 as shown in FIG. 2, in the aforementioned harness 8. The swivel configuration provides substantially increased mobility to the harnessed user, allowing the user to turn repeatedly in the same direction without twisting or knotting the lanyard.

Figure 15:
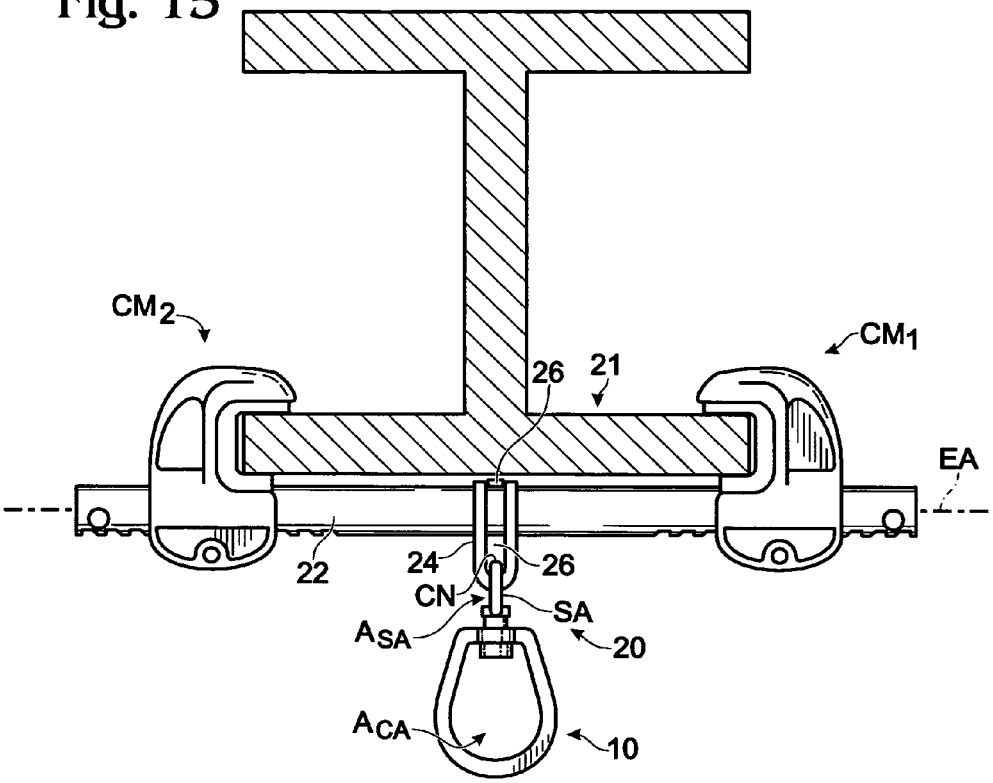
FIG. 15 is an isometric view of the D-ring attachment point of FIG. 5 used as an anchor point.

FIG. 15 shows the D-ring 10 used in an anchor point, and more particularly, in the example of an I-beam anchor point 20. Briefly, the I-beam anchor point includes an elongate cross-bar 22 having an elongate axis "EA" that supports two generally C-shaped capturing members $CM_1$ and $CM_2$ which are adjustably spaced apart for capturing the edges of an I-beam flange 21 so that the I-beam anchor point 20 hangs from the flange and can slide along the flange (into and out of the plane of the Figure). As will be readily apparent to persons of ordinary mechanical skill, generally L-shaped members could be used as an alternative to the generally C-shaped members.

The D-ring 10 is connected to the cross-bar 22 via a (typically) metal loop structure or strap 24 extending through the aperture $A_{SA}$ of the structure-attachment portion SA. The strap 24 is preferably, but not necessarily, fixed axially in place (referring to the axis EA), but is allowed to swing laterally about the cross-bar, i.e. in the plane perpendicular to the axis EA. This is functionality may be provided as shown by providing a slot 26 in the strap that extends perpendicular to the elongate axis of the cross-bar 22, the slot being axially captured to the cross-bar 22 by a projection 28 of the cross-bar 22, which may for example be a pin or the head of a screw threaded into the cross-bar, extending through the slot.

It has been found to be advantageous to provide an instance of the D-ring 10 both at the harness, such as shown in FIG. 14, as well as at the anchor point, such as shown in FIG. 15.

Like the prior art D-ring 2, the D-ring 10 is particularly adapted for use in providing fall protection to a construction worker, and has been described in that context. However, it will be appreciated that the D-ring 10 may similarly be used to provide fall protection for rock and mountain climbers, and it may be used for other purposes as well.

It is to be understood that, while a specific swivel D-ring attachment point has been shown and described as preferred, other configurations could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is;

1. A D-ring attachment point configured to tether to a user to shorten a fall of the user and provide fall protection, the D-ring attachment point comprising:

a first attachment portion having a closed first aperture therethrough defining an arc of a circle having a diameter of between 1⅞" and 2½", wherein the arc extends at least 180 degrees and is symmetrically disposed relative to a swivel axis; and a second attachment portion having a closed second aperture therethrough, wherein said second aperture is substantially rectangular, wherein said first and second attachment portions are joined together so as to permit free swivelling relative to each other around said swivel axis, said apertures being substantially centered about said swivel axis, wherein said second aperture has a substantially different shape than said first aperture for connecting to substantially different articles, wherein one of said attachment portions has an integrally formed projecting cylindrical shank and the other of said attachment portions has a corresponding cylindrical hole receiving said shank so as to form a swivel joint providing said free swivelling about said swivel axis, wherein said hole defines a cylindrical internal surface in said other of said attachment portions, wherein said D-ring attachment point has at least one pin and said internal surface has at least one groove extending 360 degrees about the swivel axis in a plane perpendicular thereto, said at least one groove providing clearance for said at least one pin configured to laterally extend from said shank; and an elongate bar member having an elongate axis, said elongate bar member supporting two spaced apart generally C or L shaped capturing members configured to clamp and hang onto the elongate bar member from a flange, wherein said second attachment portion connects to said elongate bar member between said capturing members.

2. The D-ring attachment point of claim 1, wherein said second aperture is substantially smaller than said first aperture.

* * * * *